US009494018B2

(12) United States Patent
Hammer et al.

(10) Patent No.: US 9,494,018 B2
(45) Date of Patent: Nov. 15, 2016

(54) SAND CONTROL CROSSOVER TOOL WITH MUD PULSE TELEMETRY POSITION

(71) Applicant: Baker Hughes Incorporated, Houston, TX (US)

(72) Inventors: Aaron C. Hammer, Houston, TX (US); Marc N. Samuelson, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 520 days.

(21) Appl. No.: 14/027,467

(22) Filed: Sep. 16, 2013

(65) Prior Publication Data

US 2015/0075767 A1 Mar. 19, 2015

(51) Int. Cl.

| | |
|---|---|
| ***E21B 47/06*** | (2012.01) |
| ***E21B 43/04*** | (2006.01) |
| ***E21B 34/10*** | (2006.01) |
| ***E21B 43/08*** | (2006.01) |
| ***E21B 44/00*** | (2006.01) |
| ***E21B 47/12*** | (2012.01) |
| ***E21B 47/18*** | (2012.01) |

(52) U.S. Cl.

CPC ..... *E21B 43/045* (2013.01); *E21B 34/10* (2013.01); *E21B 43/08* (2013.01); *E21B 44/005* (2013.01); *E21B 47/06* (2013.01); *E21B 47/12* (2013.01); *E21B 47/18* (2013.01)

(58) Field of Classification Search

CPC ..... E21B 47/06; E21B 47/12; E21B 47/18; E21B 44/005; E21B 43/045

See application file for complete search history.

(56) References Cited

U.S. PATENT DOCUMENTS

| | | | | |
|---|---|---|---|---|
| 5,662,170 | A | 9/1997 | Donovan et al. | |
| 5,875,852 | A * | 3/1999 | Floyd | E21B 17/003 166/191 |
| 6,464,006 | B2 | 10/2002 | Womble | |
| 7,168,508 | B2 | 1/2007 | Goldberg et al. | |
| 7,316,272 | B2 | 1/2008 | Hurst et al. | |
| 8,164,476 | B2 | 4/2012 | Hache et al. | |
| 8,230,924 | B2 | 7/2012 | Clem et al. | |
| 2007/0272404 | A1 | 11/2007 | Lynde et al. | |
| 2010/0013663 | A1 * | 1/2010 | Cavender | G01V 11/002 340/854.3 |
| 2010/0163235 | A1 | 7/2010 | Mootoo et al. | |
| 2011/0005746 | A1 | 1/2011 | Schmitt et al. | |
| 2011/0192594 | A1 * | 8/2011 | Roddy | E21B 33/13 166/250.01 |
| 2011/0241897 | A1 * | 10/2011 | Haynes | E21B 43/04 340/854.5 |
| 2012/0024523 | A1 | 2/2012 | Ayan et al. | |
| 2012/0043079 | A1 | 2/2012 | Wassouf et al. | |
| 2012/0186874 | A1 | 7/2012 | Malone et al. | |
| 2013/0112423 | A1 | 5/2013 | Dykstra et al. | |

FOREIGN PATENT DOCUMENTS

| | | |
|---|---|---|
| WO | 2012100259 | 7/2012 |

* cited by examiner

*Primary Examiner* — William P Neuder
(74) *Attorney, Agent, or Firm* — Steve Rosenblatt

(57) ABSTRACT

A completion tool for gravel packing screens incorporates an added position to allow redirection of flow to a signal transmission tool at the needed flow rates to optimize signal to noise ratios by creation of a discrete flow path that channels the desired flow directly to the device and using the production tubing and upper annulus as the balance of the flow circuit. The Smart Collet® has a landing location for this position which is preferably between the circulation and reverse positions of the crossover tool. The wash pipe assembly can have a shifting tool that closes the sleeve over the gravel exit ports for the information transmittal such ports can thereafter remain closed because the gravel packing is complete but for the reversing out of excess gravel which happens above the gravel exit ports.

25 Claims, 5 Drawing Sheets

SAND CONTROL CROSSOVER TOOL WITH MUD PULSE TELEMETRY POSITION

FIELD OF THE INVENTION

The field of the invention is completions involving frac-packing or gravel packing using a crossover tool and wash pipe and more particularly to the addition of a new crossover position between circulation and reversing out that directs flow away from screens and through a return path through a mud pulse transmitter for low noise transmission of data to a surface location during the completion operation.

BACKGROUND OF THE INVENTION

Crossover tools are used in frac-pack and gravel packing operations. In a circulation position flow comes through the tool from the tubing and laterally exits to a screen annulus. The gravel is deposited in the screen annulus while returns come through the screens and up a wash pipe and into the crossover tool that allows the path of returning fluid to continue to the surface in the upper annulus above the production packer. The return path can be closed in a squeeze operation so that the carrier fluid goes right into the formation. Using a pickup force the crossover port can be lifted to allow excess gravel to be reversed out with annulus flow pushing the gravel to the surface through the tubing. These positions are described in detail in U.S. Pat. No. 8,230,924. Also relevant in the area of gravel packing crossover tools is U.S. Pat. No. 6,464,006.

Mud pulse telemetry has been used to transmit a variety of information to the surface. It can transmit information on the distribution of gravel in a screen annulus, the conditions of the drilling mud, movement of tools such as circulation valves or the placement of service tools to name a few examples. Some of these applications and others are discussed in the following references: US20070272404; U.S. Pat. No. 7,168,508; US20110241897; WO/2012/100259A2; U.S. Pat. No. 8,164,476; U.S. Pat. No. 5,662,170; US20120186874 and U.S. Pat. No. 7,316,272.

For mud pulse telemetry to provide useful signal to noise ratios there has to be a fairly unrestricted flow path regardless of the flow direction. The circulation position in existing crossovers has a fairly restricted flow path in forward circulation leading to low signal to noise ratios and in that same crossover tool position with flow in the opposite direction the large flow area in the upper annulus will create the same low signal to noise ratios.

The present invention creates a new configuration in a crossover tool between the circulate and reverse out positions so that in the forward transmitting position the flow goes through the tubing and out of the frac port and directly back into the crossover tool upstream of the mud pulse tool before returning to the surface by emerging from the crossover tool and going up the upper annulus to the surface. Alternatively the fluid flow direction can be reversed. The Smart Collet® or similar device or pick-up distance can be used to define the data transmission position of the crossover tool between the circulation and the reverse position. The needed data can then be transmitted during the gravel packing operation in real time.

FIGS. 1-10 all labeled prior art and discussed in detail in U.S. Pat. No. 8,230,924 and are incorporated by reference herein as if fully set forth. FIGS. 11 and 12 show the existing outer assembly and inner service assembly that fits inside it, respectively. The component description of the known parts of the design will now be reviewed. The outer assembly 10 has an isolation packer 12 followed internally by a metering shoulder that is selectively engaged by the metering locator 16 that works in conjunction with the wash pipe valve 18 for its closure. The valve 18 is shown open in FIGS. 1-7 and closed in FIGS. 8-9. Gravel exit port 20 has an associated sliding sleeve 22 that is closed when the shifting tool 24 is moved past sliding sleeve 22. The Smart Collet® profile 26 is selectively engaged by the Smart Collet® 28 to define a position of the crossover tool assembly 10. Profiles 30 and 32 are used in the closing procedure for the wash pipe valve 18 as shown in FIGS. 6-8 and described in detail in U.S. Pat. No. 8,230,924. The inner assembly 34 further has a ball catcher 36 just below a frac port 38 that selectively aligns with the gravel exit ports 20 when collet 40 lands on shoulder 42. Return ports 44 allow returns during circulation to reach the upper annulus as shown by arrows in FIG. 2. The major component of the known prior tool have now been briefly introduced and a discussion of all the positions of the tool will next be described.

In FIG. 1 the packer 12 is set at the desired location using the setting tool 46 by applying tubing pressure. The packer is tested by annulus pressure represented by arrows 48. When that packer test is completed the delivery of gravel begins in the FIG. 2 position. The delivered gravel is represented by arrow 50 is shown exiting the slanted ports 20 with arrow 52 and then the gravel remains on the outside of the screens that are not shown as part of the outer assembly. The carrier fluid then enters the inner assembly 34 and passes through the open valve 18 and through the crossover by bypassing the ball catcher 36 to enter the frac port 38 for an ultimate exit through ports 44 as shown by arrow 54 and passing through the packer 12 and into the upper annulus. FIG. 3 is the squeeze position at the location of the upper annulus. At this time the carrier fluid is forced under pressure to enter the formation for fracturing. In FIG. 4 the inner assembly 34 is picked up to bring ports 38 out of the outer assembly 10 so that reverse flow represented by arrow 58 enters ports 38 from the upper annulus to sweep away excess gravel up the production tubing as represented by arrow 60. The reversing continues as weight is set down on the inner assembly 34. The reversing flow is cut off by the downward movement in FIG. 5 followed by the picking up in FIG. 6 and the setting down in FIG. 7 acts to close the wash pipe valve 18. In FIG. 8 the inner assembly 34 is raised again and additional reversing out can take place just as in FIG. 4 with the difference being that the wash pipe valve 18 is now closed. The reversing can continue as weight is set down. The removal of the inner assembly also accomplishes engaging the closing sleeve with shifting tool 24 to close off the slanted gravel exit ports 20 as shown in FIG. 10 with the inner assembly 34 removed. These steps are fully discussed in greater detail in U.S. Pat. No. 8,230,924 and represent a background to the description of the present invention which creates a new position between FIGS. 2 and 4 for the purpose of data transmission to the surface with mud pulse telemetry equipment incorporated into the inner assembly 34 and configured to be in a discrete flow circuit in the transmitting position where flow goes to the mud pulse unit without making a trip through the gravel and the screens to enhance the signal to noise ratio of the data transmission. Those skilled in the art will better understand additional aspects of the invention from a review of the description of the preferred embodiment and the associated drawings while recognizing that the full scope of the invention is to be found in the appended claims.

SUMMARY OF THE INVENTION

A completion tool for frac packing or gravel packing equipment incorporates an added position to allow redirection of flow to a signal transmission tool at the needed flow rates to optimize signal to noise ratios by creation of a discrete flow path that channels the desired flow directly to the device and using the production tubing and upper annulus or the formation as the balance of the flow circuit. The Smart Collet® has a landing location for this position which is preferably between the circulation and reverse positions of the crossover tool. The inner assembly can have a shifting tool that closes the sleeve over the gravel exit ports for the information transmittal such ports can thereafter remain closed because the gravel packing is complete but for the reversing out of excess gravel which happens above the gravel exit ports. Other orders for the timing of the transmission of data are contemplated.

DETAILED DESCRIPTION OF THE PREFERRED EMBODIMENT

Figure 1:
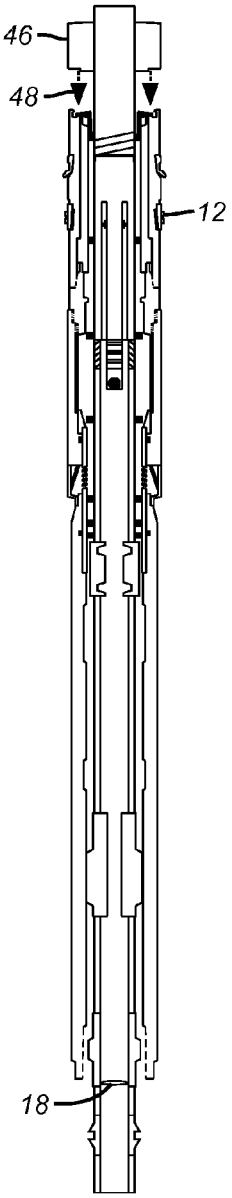
(PRIOR ART) FIG. 1
FIG. 1 is a section of a prior art gravel packing assembly with the isolation packer set and being pressure tested.
Figure 2:
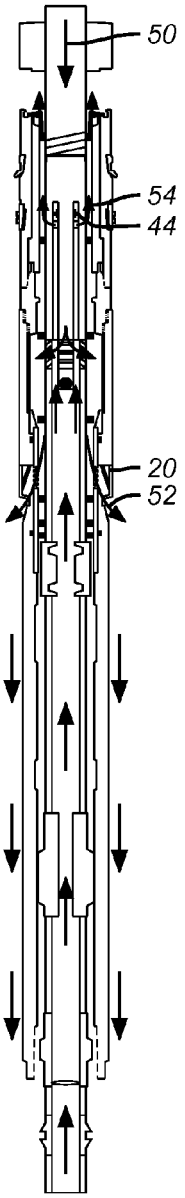
(PRIOR ART) FIG. 2
FIG. 2 is the same view as FIG. 1 with the fluid or slurry being delivered through the tubing and returns coming up the crossover assembly.
Figure 3:
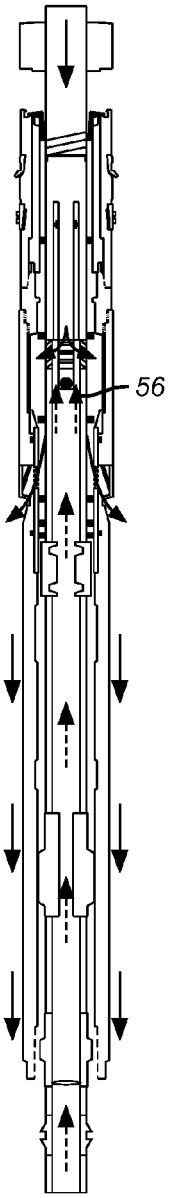
(PRIOR ART) FIG. 3
FIG. 3 is the view of FIG. 2 with the return path up the crossover assembly closed so that carrier fluid for the gravel can be squeezed into the formation.
Figure 4:
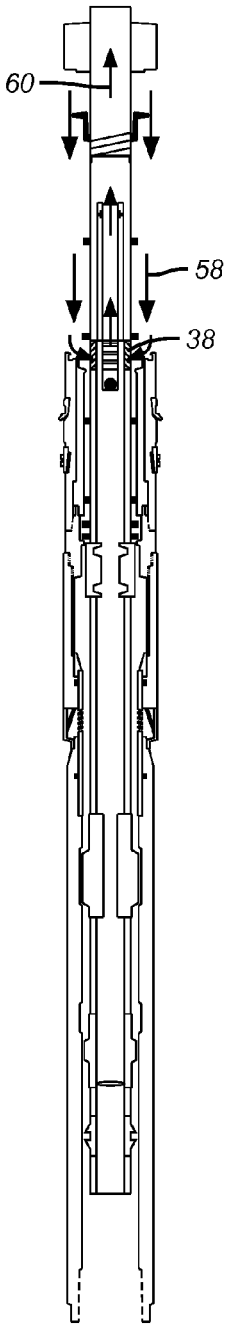
(PRIOR ART) FIG. 4
FIG. 4 is the reverse view allowing excess gravel to be removed with annulus flow.
Figure 5:
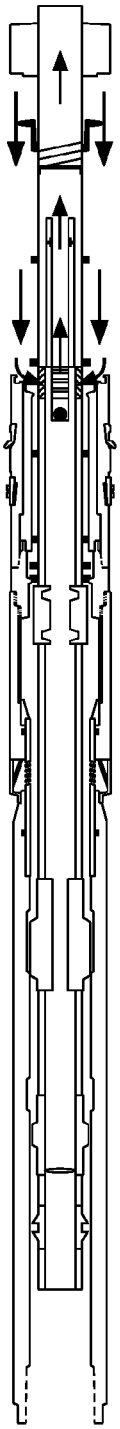
(PRIOR ART) FIG. 5
FIG. 5 is the reverse view allowing excess gravel to be removed with annulus flow while slacking off weight to a set-down position.
Figure 6:
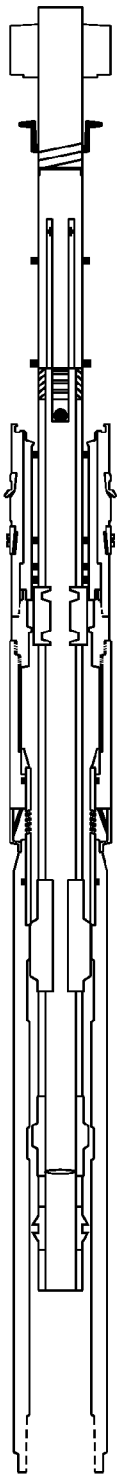
(PRIOR ART) FIG. 6
FIGS. 6-7 illustrate a movement sequence of the inner assembly designed to close the wash pipe valve.
Figure 7:
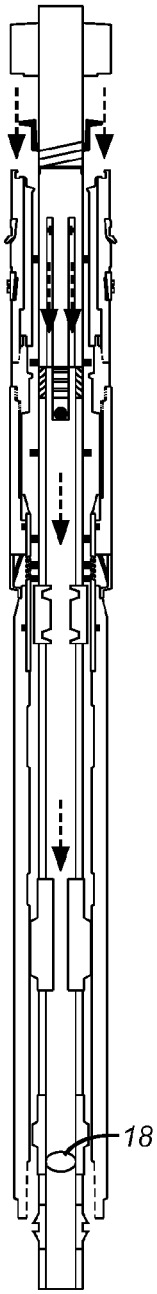
(PRIOR ART) FIG. 7
Figure 8:
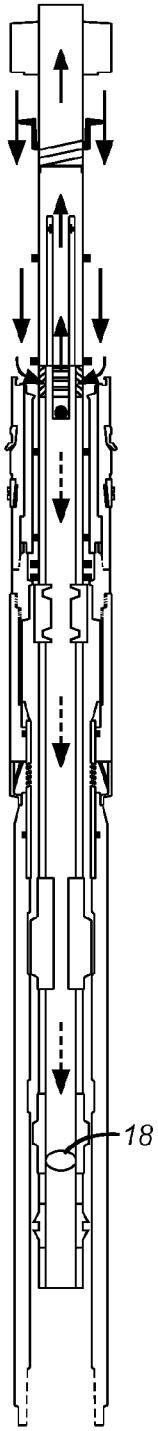
(PRIOR ART) FIG. 8
FIG. 8 shows the reversing position with the wash pipe valve closed.
Figure 9:
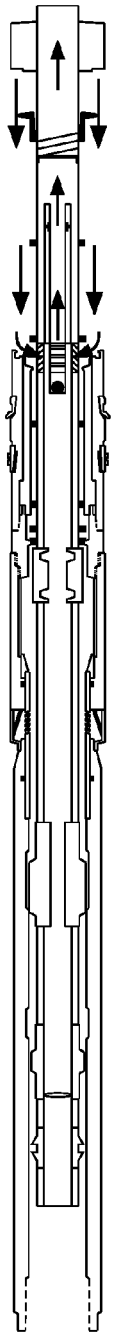
(PRIOR ART) FIG. 9
FIG. 9 shows the reversing position with the wash pipe valve closed and setting down weight on the inner assembly.
Figure 10:
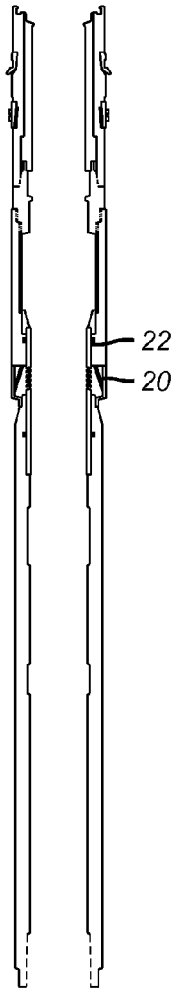
(PRIOR ART) FIG. 10
FIG. 10 is the view of FIG. 9 with the inner assembly removed and the gravel outlet ports closed.
Figure 11:
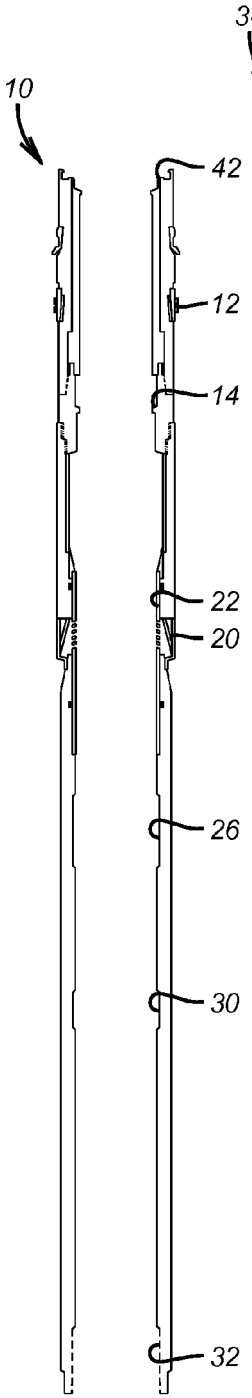
(PRIOR ART) FIG. 11
FIG. 11 is a section view of the outer assembly of FIG. 1 shown above the screens.
Figure 12:
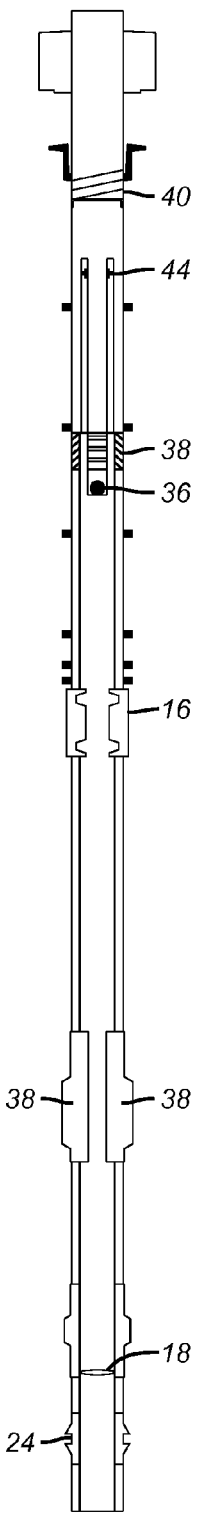
(PRIOR ART) FIG. 12
FIG. 12 is the inner assembly for the outer assembly of FIG. 11.
Figure 13:
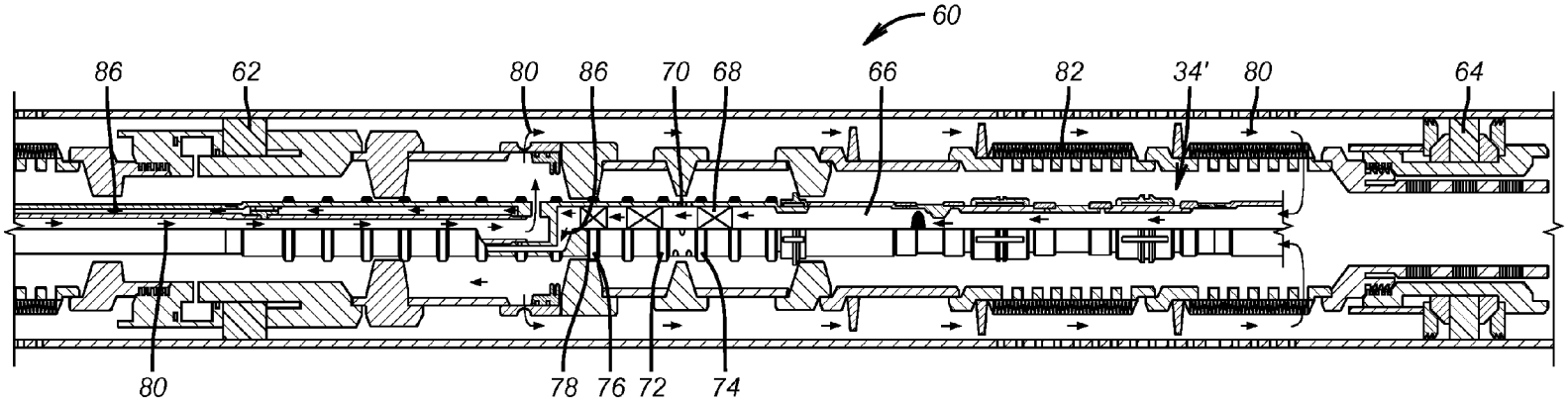
FIG. 13 is a detailed view of a the outer and inner assemblies of the present invention shown in the circulation mode.

Referring to FIG. 13 the crossover 60 is shown in a single zone isolated between packers 62 and 64. Those skilled in the art will appreciate that while a multi-zone completion is illustrated that a single zone completion is also contemplated. There are several differences in the equipment when comparing FIGS. 1-12 with FIGS. 13-15. The Inner service assembly 34' has a return path 66 in which are located pressure and/or temperature sensors/transmitters 68 followed by a wall port or ports 70 that is located between seals 72 and 74 such that when those seals or an adjacent seal 76 are in a seal bore 78, the circulating fluid represented by arrows 80 is isolated from ports 70 as is shown in FIG. 13. The gravel is deposited in the known way outside screens 82 and the returns come back through the inner string assembly 34' through the return path 66. Apart from the sensors/transmitters 68 there is a mud pulse unit 84 that takes flow through itself to operate in a known manner. Arrows 86 represent the return flow through the crossover to the upper annulus as previously described.

Figure 14:
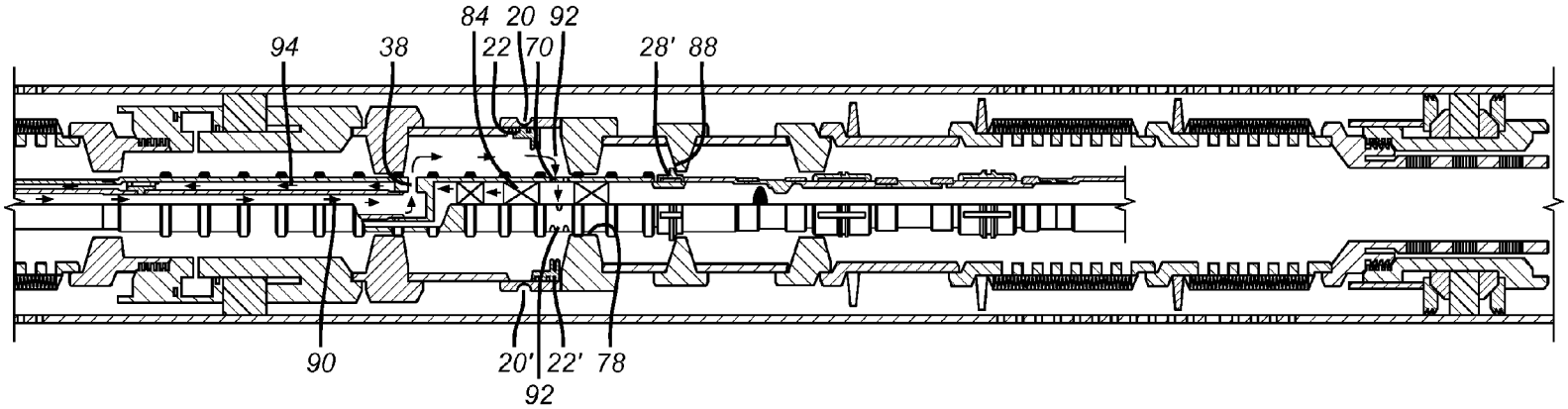
FIG. 14 is the view of FIG. 13 shifted to the data transmission mode with flow in the circulation direction.

At the desired point of the installation sequence of the sand control completion, the inner string assembly 34' is picked up so that Smart Collet 28' lands on shoulder 88 as shown in FIG. 14. Openings 70 are now out of seal bore 78 so that clean fluid circulation represented by arrows 90 can exit through frac port 38' and be redirected right into openings 70 as shown by arrows 92. Note that in FIG. 14 the sliding sleeve 22' that closes the gravel ports 20' is shown in the initial open position at the bottom of FIG. 14 and in the closed position for redirection of flow to openings 70 at the top of FIG. 14. A schematically illustrated shifting tool 92 can do the shifting to the closed position for the sleeve 22' as by that time the gravel deposition step is completed and the ports 20' can stay closed as the reversing out step previously described takes place above. Signal transmission can preferably occur before gravel deposition so as to minimize erosion of carryover gravel when reconfiguring the flow regime for data transmission. Arrows 94 illustrate the return of fluids to the upper annulus after passing through the crossover. The parts in FIG. 15 are in the same position as in FIG. 14 but the flow is in the reverse direction.

A variety of data can be sent such as set down weight on the outer assembly and local pressure readings in flow regimes that can be affected by pressure drop over a long distance in deep wells that can be over 7500 meters deep. Another piece of data can be pressure reduction rates after squeezing which give an accurate reading of the effectiveness of the fracturing during the squeeze step. Mud pulse communication can be in either direction and can be used to operate components in the completion assembly from the surface such as sleeve 22' instead of using a shifting tool such as 92 or 24 in the tool of FIGS. 1-12.

Figure 15:
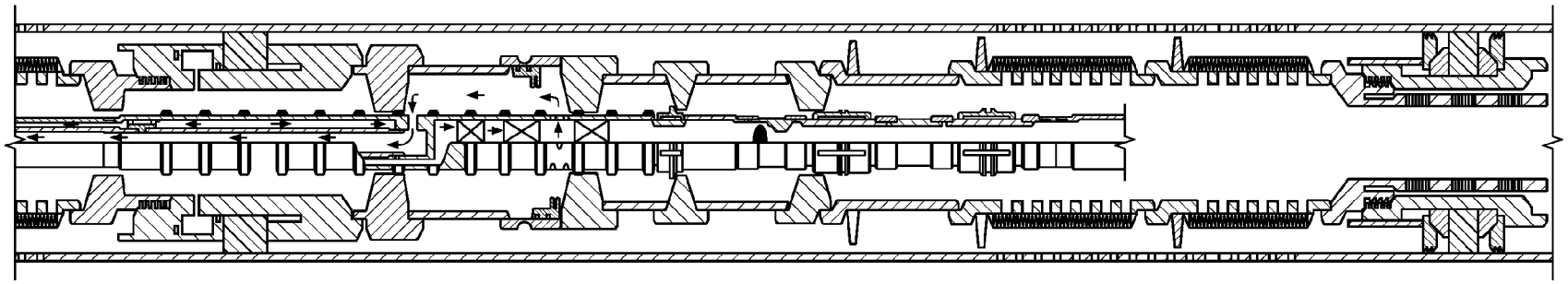
FIG. 15 is the view of FIG. 14 with the flow going in the opposite direction.
Figure 16:
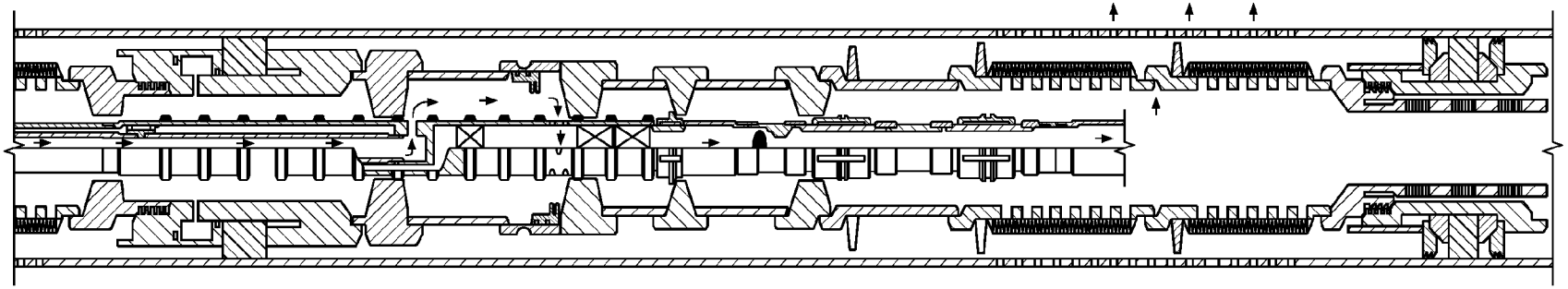
FIG. 16 is a data transmitting flow regime with flow going into the formation.

One variation of the configuration in FIGS. 14 and 15 is that the sleeve 22' does not need to be closed. If the gravel pack has concluded by the time the inner assembly 34' has been lifted from the circulation position of FIG. 13 the path of least resistance for the flow represented by arrows 92 is for the flow to go into ports 70 rather than out the gravel exit ports 20' where the flow will have to go through the gravel pack and the screens 82 to reach the same location that is reached with access through ports 70 in the FIG. 14 position. Significantly, the gravel-laden flow in FIG. 13 is isolated from the mud pulse unit 84 during the gravel deposition going on in the FIG. 13 position. The data communication mode can be an intermediate position between the circulation position of FIG. 13 and the reverse position shown in FIG. 4. The Smart Collet® is given a new landing location in FIG. 14 to identify this position. As a result the fluid circuit up to the mud pulse unit 84 is one with minimal flow restrictions that ups the signal to noise ratio. The reverse flow alternative in FIG. 15 is less preferred in that the flow area in the upper annulus is quite large and that can increase the noise to make getting the signal more difficult. Another alternative is to simply use the circulation flow scheme shown in FIG. 2 and add the mud pulse unit 84 in passage 66 as shown in FIGS. 13-15 and use the normal circulation flow during gravel deposition to transmit data to the surface. Of the alternatives discussed the flow orientation of FIG. 14 is preferred for optimal signal to noise ratios. The mud pulse unit 84 can store data for subsequent transmission when in transmission mode. More than one device can be deployed in the crossover to have the ability to transmit with opposed flow regimes in the same tool.

The invention is applicable in a broad range of downhole equipment not necessarily limited to completions such as fracturing or gravel packing. In more general terms, the invention envisions a tool with reconfigurable flow regimes through it where one is used to accomplish the intended function of the tool and another is used to send data preferably with mud pulse telemetery either before or after the use of the tool for its intended function. For space saving considerations and considerations of cost and complexity there can be a part overlap between the flow regimes. The telemetry flow regime can also be a one way path into the formation as opposed to a closed loop for circulation or reverse circulation. The change between flow regimes can occur using relative movement such as translation or rotation or combinations thereof as illustrated in the embodiment of the crossover tool described above where axial movement was used to reconfigure to the data sending flow regime with telemetry. Other ways can employ dropped objects on seats, remotely operated valves or sleeves powered in a variety of ways such as hydraulically or electrically, to name a few examples.

The above description is illustrative of the preferred embodiment and many modifications may be made by those skilled in the art without departing from the invention whose scope is to be determined from the literal and equivalent scope of the claims below:

We claim:

1. A subterranean tool assembly, comprising:

a subterranean tool having at least a first and a second flow path configuration threrethrough;

said first flow path configuration enables said tool to accomplish a predetermined function at the subterranean location and said second flow path configuration allows data transmission with at least one data transmission device that is isolated from flow in said second flow path configuration when said first flow path configuration is in use by said tool.

2. The assembly of claim 1, wherein:

said first and second flow path configurations are independent.

3. The assembly of claim 1, wherein:

said first and second flow path configurations overlap at least in part.

4. The assembly of claim 3, wherein:

said tool is reconfigured between said flow path configurations with axial relative movement.

5. The assembly of claim 1, wherein:

said tool is reconfigured between said flow path configurations with relative movement in at least one direction.

6. The assembly of claim 1, wherein:

said tool is reconfigured between said flow path configurations with applied pressure or valve operation.

7. The assembly of claim 4, wherein:

said tool comprises an inner assembly movable relatively to an outer assembly to define at least three flow path configurations selectively obtained with axial relative movement between said inner and outer assemblies.

8. The assembly of claim 7, wherein:

end locations for said relative movement define two of said flow path configurations and an intermediate position between said end locations defines said third flow path configuration.

9. The assembly of claim 8, wherein:

said second flow path configuration is enabled in said intermediate position.

10. A subterranean tool assembly, comprising:

a subterranean tool having at least a first and a second flow path configuration threrethrough;

said first flow path configuration enables said tool to accomplish a predetermined function at the subterranean location and said second flow path configuration allows data transmission with at least one data transmission device that is isolated from flow in said second flow path configuration when said first flow path configuration is in use by said tool;

said first and second flow path configurations overlap at least in part;

said tool is reconfigured between said flow path configurations with axial relative movement;

said tool comprises an inner assembly movable relatively to an outer assembly to define at least three flow path configurations selectively obtained with axial relative movement between said inner and outer assemblies;

end locations for said relative movement define two of said flow path configurations and an intermediate position between said end locations defines said third flow path configuration;

said outer assembly comprising at least one screen;

said inner assembly is relatively movable with respect to said outer assembly and further comprising a crossover tool for configuring the assembly in said first flow path configuration to at least deposit gravel in a screen annulus in a circulation position and pass carrier fluid through said screen to an upper annulus above a packer or squeeze fluid into a formation and in said third flow path configuration to a reverse position where said inner assembly is raised with respect to said outer assembly to expose a gravel exit port to allow flow going down the upper annulus to enter said gravel exit port and carry off excess gravel to a surface location through a string supporting said inner assembly;

said data transmission device positioned in said crossover in said second flow path configuration in a manner that isolates said data transmission device from flowing gravel transported in said carrier fluid in said first or third said flow path configurations.

11. The assembly of claim 10, wherein:

said data transmission device has return flow through a passage therein that is aligned with a passage in said crossover that receives carrier fluid that has passed through said screen.

12. The assembly of claim 10, wherein:

said crossover is movable to a data transmission second flow path configuration such that fluid that enters an inlet to said crossover can exit through a gravel exit port in said crossover and into a return portion of said crossover through a wall port on said inner assembly that is opened to said gravel exit port by movement to said second flow path configuration.

13. The assembly of claim 12, wherein:

said wall port is obstructed by placement in a seal bore in said circulation position.

14. The assembly of claim 13, wherein:

said data transmission position using said second flow path configuration is defined by a locating device.

15. The assembly of claim 10, wherein:

said data transmission device comprises a mud pulse transmitter.

16. The assembly of claim 10, wherein:

said data transmission device functions when said second flow path configuration is selected with flow going through said crossover in opposed directions or in a single direction.

17. The assembly of claim 10, wherein:

said outer assembly having a gravel exit port that stays open when said data transmission device sends data.

18. The assembly of claim 12, wherein:

said outer assembly having a gravel exit port that is closed when said data transmission device sends data.

19. The assembly of claim 13, wherein:

said wall port is opened by removal from said seal bore for communication with at least a portion of fluid exiting said gravel exit port.

20. The assembly of claim 10, wherein:

said data transmission device sends data regarding a set down weight of said inner assembly on said outer assembly.

21. The assembly of claim 10, wherein:

said data transmission device sends data regarding pressure decline rates in a surrounding formation after applied pressure to the formation is removed.

22. The assembly of claim 10, wherein:

said data transmission device sends data regarding pressure measured adjacent said crossover with fluid moving through said crossover.

23. The assembly of claim 10, wherein:

said data transmission device stores data for subsequent transmission.

24. The assembly of claim 10, wherein:

said data transmission device operates a component on said inner or outer assemblies.

25. The assembly of claim 10, further comprising:

said at least one data transmission device further comprises a plurality of data transmission devices with opposed orientations provided to accommodate opposed flow path configurations for the same or different purposes.

* * * * *